US006979181B1

(12) United States Patent
Kidd

(10) Patent No.: US 6,979,181 B1
(45) Date of Patent: Dec. 27, 2005

(54) METHOD FOR CONTROLLING THE MOTOR OF A PUMP INVOLVING THE DETERMINATION AND SYNCHRONIZATION OF THE POINT OF MAXIMUM TORQUE WITH A TABLE OF VALUES USED TO EFFICIENTLY DRIVE THE MOTOR

(75) Inventor: Howard Keith Kidd, Christiansburg, VA (US)

(73) Assignee: Aspen Motion Technologies, Inc., Radford, VA (US)

( * ) Notice: Subject to any disclaimer, the term of this patent is extended or adjusted under 35 U.S.C. 154(b) by 0 days.

(21) Appl. No.: 10/307,046

(22) Filed: Nov. 27, 2002

(51) Int. Cl.[7] ..... F04B 49/20

(52) U.S. Cl. ..... 417/44.2; 417/45; 417/53; 318/432; 318/361; 318/254

(58) Field of Search ..... 417/44.1, 44.2, 417/18, 22, 53, 250, 280, 410.1, 476, 45; 92/72; 318/808, 432, 361, 254, 439, 85, 437

(56) References Cited

U.S. PATENT DOCUMENTS

| | | | | |
|---|---|---|---|---|
| 4,511,312 A | * | 4/1985 | Hartwig | 417/45 |
| 4,546,293 A | * | 10/1985 | Peterson et al. | 318/254 |
| 4,971,522 A | * | 11/1990 | Butlin | 417/18 |
| 5,168,777 A | * | 12/1992 | Isono et al. | 477/152 |
| 5,563,490 A | * | 10/1996 | Kawaguchi et al. | 318/808 |
| 5,778,329 A | * | 7/1998 | Officer et al. | 701/55 |
| 6,051,952 A | * | 4/2000 | Moreira et al. | 318/738 |
| 6,074,170 A | | 6/2000 | Bert et al. | |
| 6,132,010 A | * | 10/2000 | Holt et al. | 303/11 |
| 6,414,455 B1 | * | 7/2002 | Watson | 318/432 |
| 6,481,973 B1 | * | 11/2002 | Struthers | 417/36 |
| 2001/0000611 A1 | * | 5/2001 | Cline et al. | 222/1 |
| 2004/0084179 A1 | * | 5/2004 | Watson et al. | 166/250.15 |

FOREIGN PATENT DOCUMENTS

| | | |
|---|---|---|
| WO | WO00/25416 | 5/2000 |

* cited by examiner

*Primary Examiner*—Timothy S. Thorpe
*Assistant Examiner*—Emmanuel Sayoc
(74) *Attorney, Agent, or Firm*—Quarles & Brady LLP

(57) ABSTRACT

A method for controlling a motor (11) driving a pump (10) using a microcomputer (14) includes repeatedly sampling a parameter representative of motor torque over one cycle of operation of the pump (10), determining at least one point of maximum motor torque during said one cycle of operation of the pump (FIG. 4); applying speed commands to the motor (11) from a table of stored speed values in memory (19), said values being selected to provide relatively greater speed commands at points of lower motor torque and relatively lesser speed commands at points of higher pump pressure corresponding to higher motor torque, while maintaining at least a base speed command to prevent stalling; and synchronizing the first value in the table of stored values to the point of maximum motor torque.

14 Claims, 5 Drawing Sheets

METHOD FOR CONTROLLING THE MOTOR OF A PUMP INVOLVING THE DETERMINATION AND SYNCHRONIZATION OF THE POINT OF MAXIMUM TORQUE WITH A TABLE OF VALUES USED TO EFFICIENTLY DRIVE THE MOTOR

TECHNICAL FIELD

The field of the invention is methods and electronic motor controls for controlling a motor that drives a cyclical pump load.

DESCRIPTION OF THE BACKGROUND ART

Piedl et al., PCT Pub. No. WO 00/25416, published May 4, 2000, discloses a system for controlling a pump load, in which the pump is coupled to an electric motor through a crankshaft, such that pump operation is sensed indirectly to eliminate the need for a pressure sensor or a position sensor.

Bert et al., U.S. Pat. No. 6,074,170, shows that it is known in the art to sense pump pressure and to adjust the speed of the motor in response to pump pressure using a microcomputer. This system regulates pump pressure through a pressure loop operating at about 3 Hz.

A technical problem in driving a pump load with an electric motor is that the highly cyclic torque load of the pump produces a high RMS current in the motor, resulting in excessive heating in the motor and higher than necessary loading on the power source. If the electronic control for the motor is required to maintain a constant speed during this pump cycle, as is often specified, the RMS current problem becomes even greater. In order to solve this problem, many applications require that an inertial load in the form of a mechanical flywheel be added to the motor to even out or "level the load" placed on the motor.

SUMMARY OF THE INVENTION

The present invention relates to a method that can be utilized by a drive system containing a microcomputer to control the speed of the electric motor in such a way as to level the load on the motor, and thereby reduce RMS current in the motor.

The invention relates to a method comprising: repeatedly sampling a parameter representative of motor torque over one cycle of operation of the pump; determining at least one point of maximum motor torque during the cycle of operation of the pump; applying speed commands to the motor from a table of stored values, said values being selected to provide relatively greater speed commands at points of lower torque and relatively lesser speed commands at points of higher torque, while providing at least a base speed command to prevent stalling; and synchronizing the first speed command value in the table of stored values to the point of maximum motor torque.

The invention improves on the prior art by allowing a speed control loop operating at least at 100 Hz. as compared with 3 Hz. for a system with direct pressure sensing of the pump. In a preferred embodiment the parameter representing motor torque is pump pressure, but other methods of sensing motor torque could be used in the invention.

Other objects and advantages of the invention, besides those discussed above, will be apparent to those of ordinary skill in the art from the description of the preferred embodiments which follows. In the description reference is made to the accompanying drawings, which form a part hereof, and which illustrate examples of the invention. Such examples, however are not exhaustive of the various embodiments of the invention, and therefore reference is made to the claims which follow the description for determining the scope of the invention.

DETAILED DESCRIPTION OF THE PREFERRED EMBODIMENTS

Figure 1:
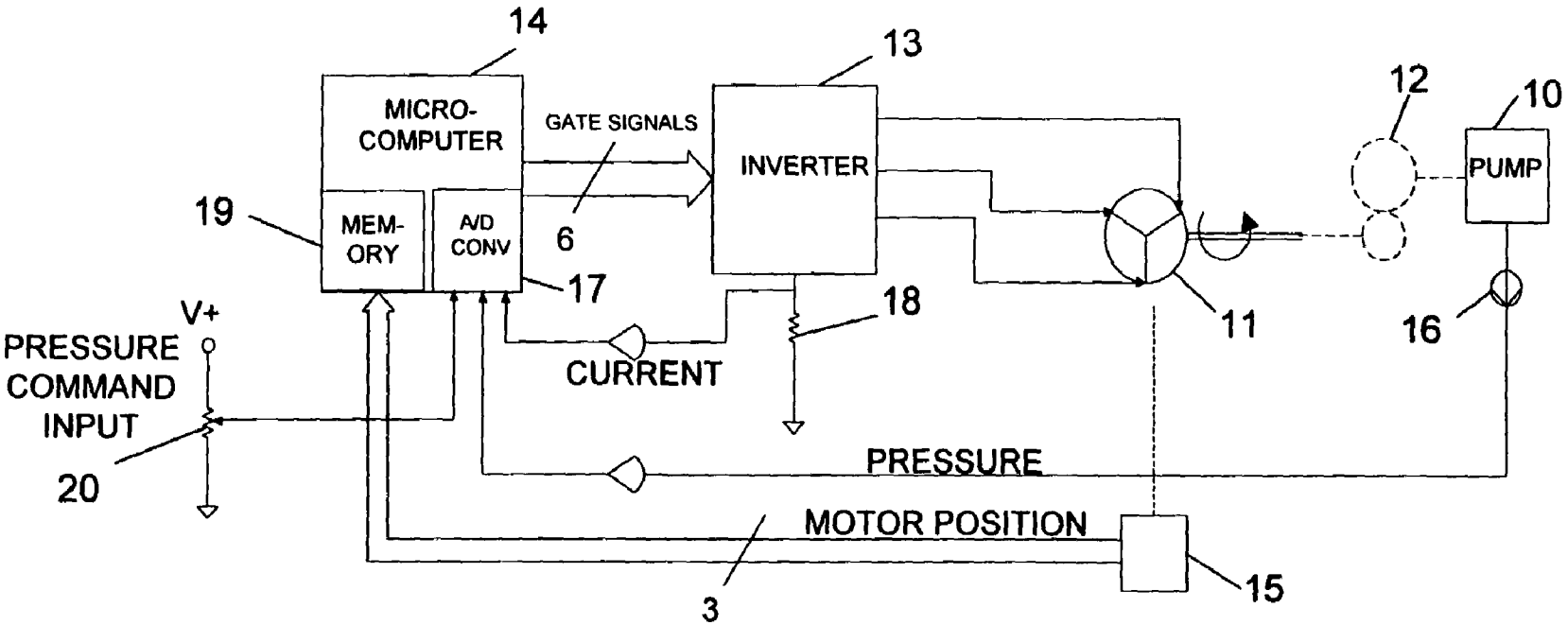
FIG. 1 is a block diagram of a motor control system that incorporates the present invention.

The present invention is made in the context of a motor control system seen in FIG. 1. A pump 10 is coupled to the output shaft of an electric motor 11 through a gear mechanism 12. The motor 11 is a three-phase brushless DC motor which is commutated through an inverter 13 according to switching signals received from a microcomputer 14. The motor 11 is provided with a position sensor 15, which in this embodiment is provided by Hall devices, but could also be provided by an encoder or a resolver. The position sensor 15 provides MOTOR POSITION feedback signals to the microcomputer 14. In addition, the pump 10 has a pressure sensor 16 which provides a PRESSURE feedback signal to an A-to-D conversion section 17 of the microcomputer 14. A current sensing device 18 is installed in the inverter 13 and provides a CURRENT feedback signal to the A-to-D conversion section 17 of the microcomputer 14. Also shown in FIG. 1 is an input device 20 for commanding a level of average pressure for the pump. The microcomputer 14 operates under the control of a program stored in a memory 19, which may be on-board the microcomputer 14. External memory could also be used for this purpose. The microcomputer 14 is programmed to operate a current loop, a speed/position loop, and in the case of this pump control system, a pressure loop as well.

The present invention was made to assist motors in meeting thermal specifications, so that the motors would not exhibit undue heating when running at the pump's maximum load point.

Figure 2:
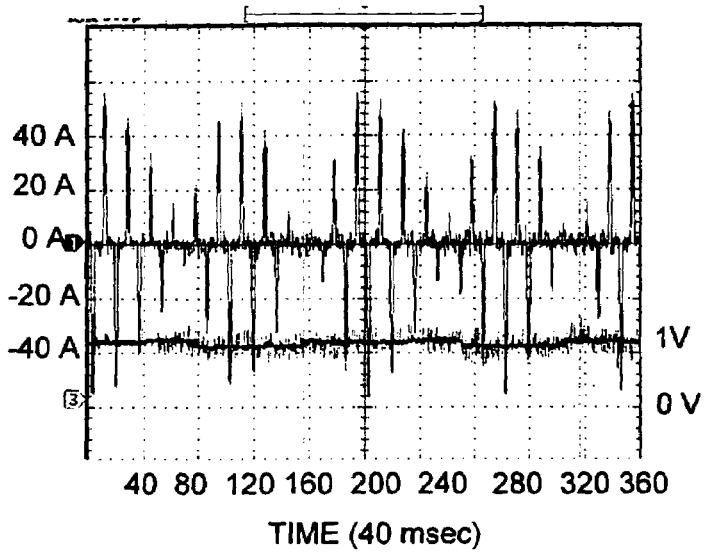
FIG. 2 is an oscillograph of instantaneous current vs. time for a ⅔ GPM pump operating at maximum load point under constant speed control (speed command also shown as a function of voltage) with no "load-leveling" applied.

FIG. 2 shows the AC line current of a ⅔ GPM (gallon per minute) pump when operating at the maximum load under constant speed control. The top waveform demonstrates the "charging" peaks of electrical current which are typical of a rectifier-capacitor input power stage. Each current spike occurs during a half cycle of the 60 Hz. AC line frequency. It can be seen that some of the current spikes reach amplitudes in excess of fifty (50) amps, while at other points there is negligible current being drawn. As might be expected, the high current peaks correspond to the high torque load points within the pump cycle. There, the pump piston is at its highest speed, mid-stroke position and is pressurizing, or pumping up, the output pressure. The very low current points correspond to points where the piston is reversing direction and or when no work is being performed. The net result is a significantly higher RMS current value than would have been measured if all the current peaks were at lower constant amplitudes. In this example, the RMS currents shown in the oscillograph measure 14.96 amps, which is only slightly less than the maximum specified current of 15 amps. The bottom waveform in the oscillograph is an analog representation of the velocity loop's constant speed command signal.

Figure 3:
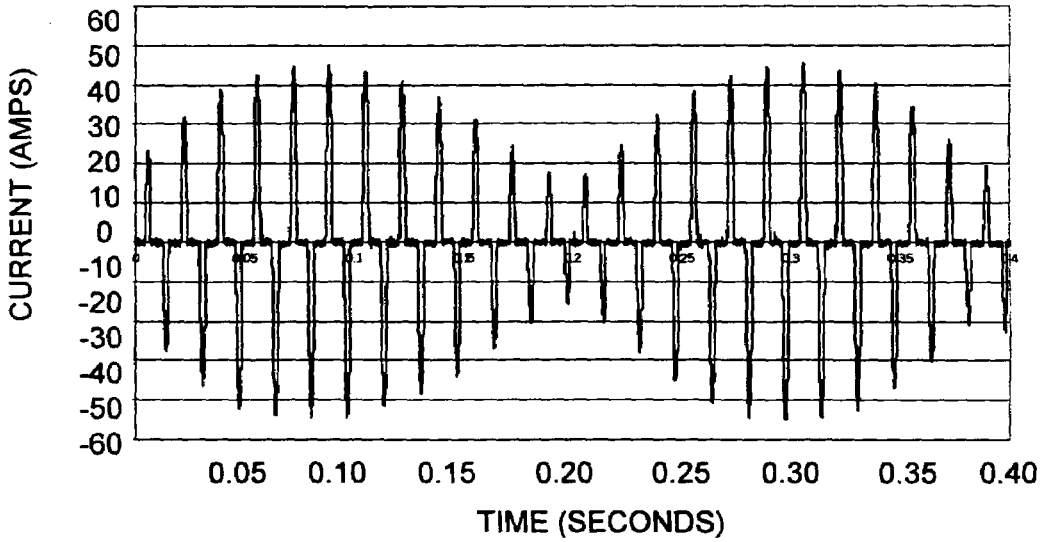
FIG. 3 is a graph of AC line current vs. time for a ¾ GPM pump when operating without speed control and with speed limited by bus voltage.

An object of the present invention is to accomplish "load-leveling" without adding a mechanical inertial device such as a flywheel. In a test to identify sources of losses in the motor, the speed control was disabled and the motor speed limited by varying the AC line voltage. The AC line current seen in a ¾ GPM pump running without speed control and speed limited by bus voltage is shown in FIG. 3. It was observed (FIG. 3) that under these conditions that the motor speed varied considerably with the torque load and the AC line current peaks were more constant. It can be seen that although there is approximately a 3:1 difference in the highest and lowest peaks, there is no point in the cycle when the current goes to zero. Another object of the invention was to provide the speed variation with torque that was observed in this test, while still maintaining motor speed control.

The effectiveness of the present invention is dependent upon the ability of the system to determine the position of the pump piston within its cycle. As a further consideration, if the motor drives the pump through gearing, it is necessary to know the exact correlation between motor rotation and pump movement. Therefore, there could be several embodiments of the invention depending upon the feedback mechanism utilized and depending upon whether the pump is driven through a gear mechanism or not. In the preferred embodiment illustrated herein, the signal from a pressure transducer 16 is monitored by the microcomputer 14. Since the output of the pressure transducer varies in a cyclical manner as the pump runs, the position of the pump piston can be determined by the microcomputer 14 from this signal. The described system also has a multi-stage gear train 12 between the motor and piston.

Figure 4:
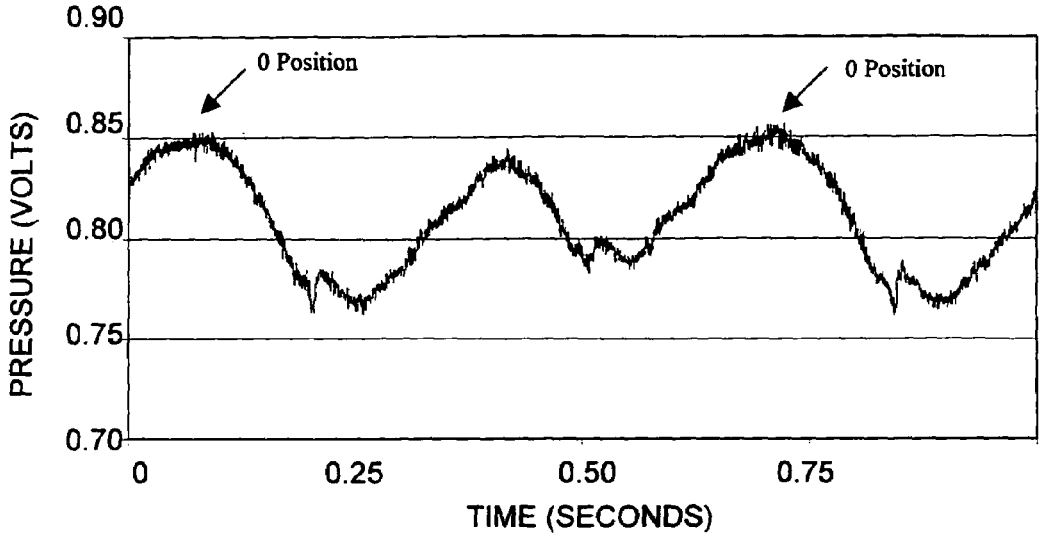
FIG. 4 is a graph representing the analog output signal from the pressure transducer of a ¾ GPM pump while operating at a constant average pressure of 1000 PSI.

FIG. 4 is a graph representing the analog output signal from the pressure transducer of a ¾ GPM pump while operating at a constant average pressure of 1000 PSI. It can be seen from the chart that there are two "pressurizing" peaks for one pump cycle. In this example, the pump cycle has a period of approx. 0.65 seconds. It can also be seen that one of the peaks is higher than the other. Therefore, in order to keep track of the pump position, it is necessary for the microcomputer to track the pressure signal over a pump cycle and to determine where in the cycle the peak pressure occurs. By digitizing the analog transducer signal with an A/D converter 17, the microcomputer 14 is able to monitor the signal amplitude. A test that must be met before determining the peak pressure point within the cycle is that the beginning and ending pressure readings in a complete cycle should agree within 5 counts, or approx. 16 millivolts. This test insures that the average pressure within the cycle is varying minimally and that the maximum pressure point found is at a consistent location within the cycle. If the pump cycle meets this test, then the maximum pressure point found within this cycle becomes the "0 position" for applying the first speed command, which has the least offset from the base speed command. If the pump is just beginning operation after the application of power, then "load-leveling" will not start until a qualifying cycle has occurred and the "0 position" has been located. If the "0 position" has been located in a prior operational cycle after the application of power, but the current cycle fails to meet the 5 count qualification, then the present cycle's pressure data is ignored and the "0 position" from the previous qualifying cycle is used. The two arrows in FIG. 4 point out the maximum pressure and therefore the "0 position" within a pump cycle.

After the "0 position" has been determined, the microcomputer can start controlling the motor speed in such a way as to minimize RMS current and "level the load". When "load-leveling" is in operation, a speed profile is followed that, in effect, slows the motor during the high torque portions of the pump cycle, and accelerates the motor during low torque portions of the pump cycle. The speed profile that was adopted approximates the motor speed behavior observed in the test illustrated in FIG. 3.

Figure 5:
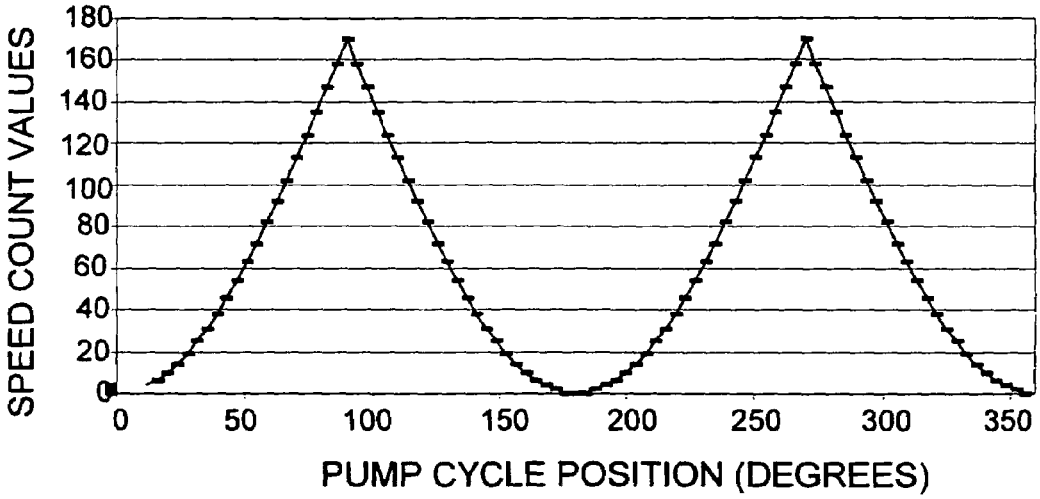
FIG. 5 is a graph of speed count values used to control speed as a function of pump position in degrees.

FIG. 5 represents the table of stored values for a profile used for the ⅔ GPM pump. This profile represents a speed "offset" in counts that is added to the motor's base speed command to cause the motor to speed up and slow down during a pump cycle. A lookup table of values is stored in the memory 19 associated with the microcomputer 14. Since there are two essentially identical "high-low" pressure patterns within one pump cycle, it is only necessary to store values for one half of a pump cycle in the lookup table in the microcomputer's memory 19. Therefore the pattern is repeated twice for 360 degrees of pump motion. Each lookup value in the table is used for approx. 4 degrees of a 360-degree pump movement. The pump's "0 position", discussed previously, corresponds approximately to the 0 degrees position on the chart. In actual application though, it is generally necessary to "phase advance" the profile slightly to account for any lag or bandwidth limitations of the microcomputer's speed loop.

A further refinement of the invention is to scale the "speed offset" through a multiplier variable that varies based upon the base speed command. For instance, if the motor base speed command is 5000 RPM, the multiplier variable might be a value of 8. The lookup table value would be multiplied by the variable to give a "peak" of the "base+offset" speed command in excess of 6000 RPM. The multiplier could then be scaled down with decreasing speed to a minimum of 0 at a base motor speed command of 1000 RPM. Therefore, at a base speed command of 1000 RPM or below, there would be no offset applied.

Figure 6:
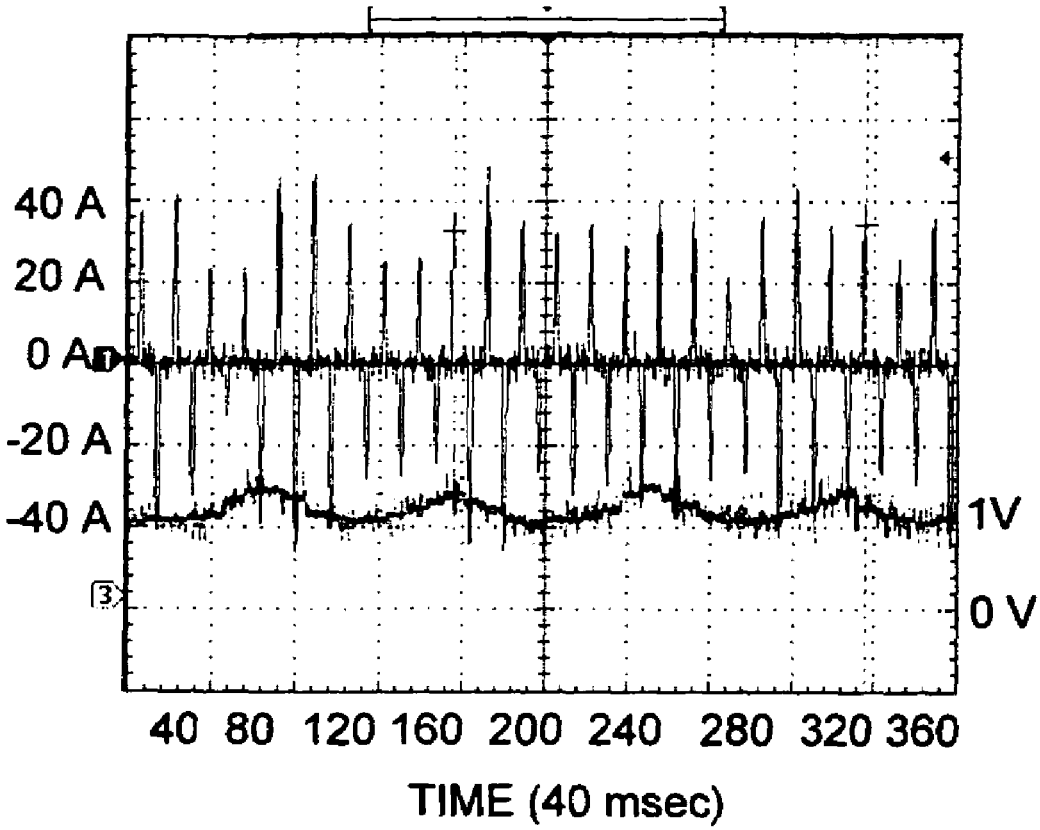
FIG. 6 is an oscillograph of instantaneous current vs. time for a ⅔ GPM pump operating at maximum load point as in FIG. 2 (speed command also shown as a function of voltage), but now utilizing the method of the present invention.

FIG. 6 shows the AC line current in response to a "base+offset" speed command of a ⅔ GPM pump operating with the "load-leveling" method of the present invention. When compared to the unit operated without "load-leveling" in FIG. 2, it can be seen that the AC line current peaks are more constant and therefore the RMS current value is reduced. A calculation of the RMS current shows a decrease of approx. 2 amps in RMS current, from 14.96 amps to 12.9 amps when the "load-leveling" method is applied under the same load conditions. The lower waveform in FIG. 5 shows a speed command typical of a unit with the "load-leveling" profile added.

Figure 7:
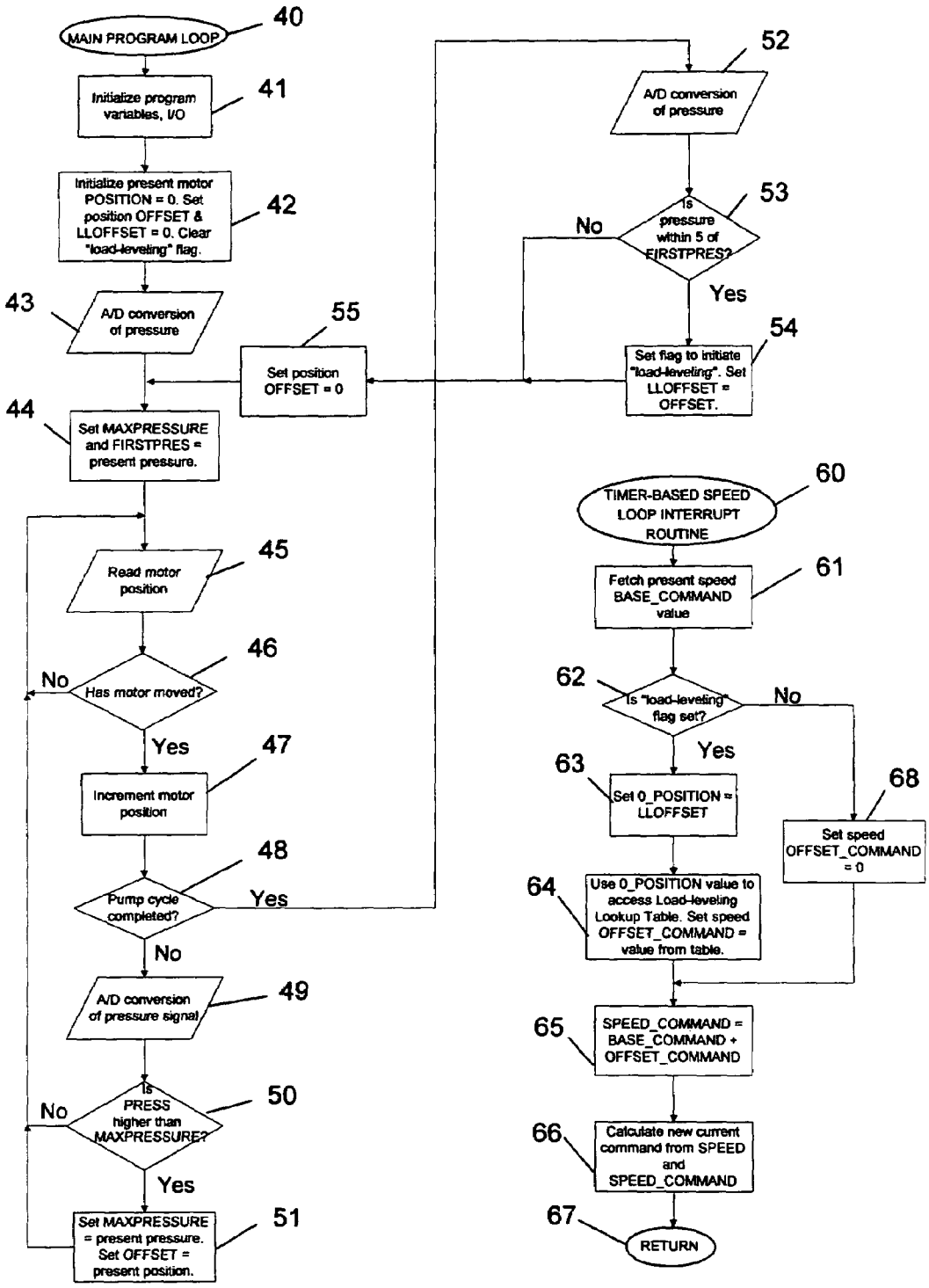
FIG. 7 is a program flow chart illustrating the method of the present invention.

FIG. 7 is a flow diagram of the "load-leveling" program routines of the present invention. In the described embodiment, the "load-leveling" program routines are included within the motor control program stored in memory 19 as described in relation to FIG. 1.

A main program loop begins with start block 40 in which the blocks represent one or more program instructions which are executed by the microcomputer 14. Upon startup, program instructions are executed, as represented by process block 41 to initialize program variables to inputs and outputs on the microcomputer 14. Then, as represented by process block 42, several key variables, including motor position (POSITION), position offset (OFFSET) and load-leveling offset (LLOFFSET) are initialized to "0".

A pressure reading is made, as represented by I/O block 43. Each pressure reading corresponds to a motor position. A variable called "MAXPRESSURE" and a variable called "FIRSTPRESSURE" are set to the first pressure reading as represented by process block 44. Then, a corresponding motor position is read as represented by I/O block 45.

Next, a check is made, as shown by decision block 46, to see if the motor has moved to a next position, and if the answer is "Yes," as represented by the "Yes" branch from block 46, then the motor position (POSITION) is incremented as represented by process block 47. If the result is "No", the routine loops back to monitor the variable POSITION until a new position is detected. At each new motor position, a check is made, as represented by decision block 48, to see if it is the last motor position in a pump cycle, such as by checking whether the number of 800 motor positions in a pump cycle has been saved. Assuming a pump cycle has not been completed, as represented by the "No" result from decision block 48, another pressure reading is input, as represented by I/O block 49. A comparison is then made, as represented by decision block 50 to see if the current pressure is greater than the maximum pressure detected thus far. If so, as represented by the "Yes" result from decision block 50, then the MAXPRESSURE is set to the current pressure and the OFFSET position is set to the current motor position, as represented by process block 51 and the routine loops back to read the next motor position at block 45. If the result is "No" in block 50, the MAXPRESSURE remains at its previous value, and the routine loops back to read the next motor position at block 45. In this way, the routine cycles through 800 motor positions to find a maximum pressure reading at a given motor position.

At the end of pump cycle, as represented by the "Yes" result from decision block 48, a check is made to see if the beginning and ending pressure readings in a complete cycle are within 5 counts, or approx. 16 millivolts. This test insures that the average pressure within the cycle is varying minimally and that the maximum pressure point found is at a consistent location within the cycle. This is checked in blocks 52 and 53, and if the result is "Yes", a flag is set to allow the running of the "load-leveling" routine, as represented by process block 54. In addition, the OFFSET position (corresponding to maximum pressure) is loaded into the LLOFFSET variable. This value will be used to synchronize the load leveling routine to start at the maximum pressure position where the offset speed command will be the lowest. If the test in block 52 results in a negative result, the position OFFSET variable is set to zero, and the data is collected for another pump cycle, as represented by the "No" result from decision block 52 and process block 54.

A speed control routine operates as a timed interrupt routine. Periodically, this routine is run, as represented by start block 60. First, a base speed command is retrieved as represented by process block 61. Next, a check is made of the load-leveling flag, as represented by process block 62. If this flag is not set, an OFFSET_COMMAND is set to zero, and the routine will not be effective to alter the base motor speed. If the flag has been set, as described above, then LLOFFSET position is loaded into a 0_POSITION storage location in memory as represented by process block 63. This is used as an index to the first position in a speed command lookup table in memory 19 as represented by process block 64. The speed command value becomes the speed OFFSET_COMMAND. As represented by process block 65, the OFFSET_COMMAND is added to the BASE_COMMAND (base speed command) to arrive at a final speed command, labeled as "SPEED_COMMAND". As part of this process block 65, the OFFSET_COMMAND may be multiplied by a factor from "1" to "8", based on the BASE_COMMAND. A new current command is then calculated based on speed feedback (SPEED) and the "SPEED_COMMAND" developed from the load leveling speed control routine, as represented by process block 66. The routine then ends and a return is made to the routine that was interrupted at the beginning of this routine, as represented by return block 67.

This has been a description of the preferred embodiments of the invention. The present invention is intended to encompass additional embodiments including modifications to the details described above which would nevertheless come within the scope of the following claims.

I claim:

1. A method of controlling a motor for driving a pump load, the method being practiced in a motor drive and the method comprising:

testing pump pressure at a beginning and at the end of a pump cycle and comparing average pump pressure to a tolerance factor to determine that average pump pressure within the pump cycle has not changed significantly so as to effect a point of maximum motor torque;

repeatedly sampling a pump pressure that is representative of motor torque over one cycle of operation of the pump;

determining and identifying at least one point of maximum motor torque during said one cycle of operation of the pump;

synchronizing a first value in a table of stored values to the point of maximum motor torque; and applying speed commands to the motor from the table of stored values after synchronizing to the first value, said values being selected to provide relatively greater speed commands at points of lower motor torque and relatively lesser speed commands at points of higher pump pressure corresponding to higher motor torque, while maintaining at least a base speed command to prevent stalling.

2. The method of claim 1, wherein pump pressure is sampled at a frequency of at least 800 times in each pump cycle in determining the point of maximum motor torque.

3. The method of claim 1, wherein the table of stored speed commands includes commands for output for at least each four degrees of a 360-degree pump cycle.

4. The method of claim 1, wherein speed commands are output at a frequency of at least 100 Hz.

5. The method of claim 1, wherein stored speed commands are multiplied by a multiplier in response to base speed before being added to the base speed command.

6. The method of claim 1, wherein the synchronizing includes a phase advance to account for any lag or bandwidth limitations of a microcomputer's speed loop.

7. The method of claim 1, for controlling a motor for driving a pump load, further comprising determining a table of stored values by executing a first portion of a computer program stored in the motor drive, the motor drive executing also applying speed commands to the motor from a table of stored values by executing a second portion of a computer program stored in the motor drive.

8. A computer program stored in a tangible medium and operable in at least one microcomputer-based motor control system, the computer program comprising:

instructions for testing for pump pressure at a beginning and at an end of a pump cycle and comparing pump pressure to a tolerance factor to determine that an average pump pressure has not changed so as to effect a point of maximum motor torque;

instructions for repeatedly sampling pump pressure representative of motor torque over one cycle of operation of the pump;

instructions for determining and identifying at least one point of maximum motor torque during one cycle of operation of the pump;

at least one instruction for synchronizing a first value in a table of stored values to the point of maximum motor torque; and instructions for applying speed commands to the motor from a table of stored values after synchronizing to the first value, said values being selected to provide relatively greater speed commands at points of lower pump pressure and relatively lesser speed commands at points of higher pump pressure, while maintaining a base speed command to prevent stalling.

9. The computer program of claim 8, wherein pump pressure is sampled at a frequency of at least 800 times in each pump cycle in determining the point of maximum motor torque.

10. The computer program of claim 8, wherein the table of stored speed commands includes commands for output for at least each four degrees of a 360-degree pump cycle.

11. The computer program of claim 8, further comprising instructions for outputting speed commands at a frequency of at least 100 Hz.

12. The computer program of claim 8, further comprising instructions for multiplying stored speed commands by a multiplier in response to base speed before being added to a base speed command.

13. The computer program of claim 8, further comprising instructions for phase advance of the table of stored speed values slightly to account for any lag or bandwidth limitations of a microcomputer's speed loop.

14. The computer program of claim 8, wherein the computer program further comprises instructions for determining a table of stored values of speed commands for applying to the motor, which instructions are executed prior to the instructions for applying the speed commands to the motor.

* * * * *